US011764021B2

(12) United States Patent
Jung

(10) Patent No.: US 11,764,021 B2
(45) Date of Patent: Sep. 19, 2023

(54) INDUSTRIAL CUT-OFF SWITCH FOR VISUAL IDENTIFICATION OF POWER SYSTEM CUT-OFF STATUS

(71) Applicant: HYUNDAI TECH CO., LTD., Seoul (KR)

(72) Inventor: Jae Gyo Jung, Seoul (KR)

(73) Assignee: HYUNDAI TECH CO., LTD., Seoul (KR)

( * ) Notice: Subject to any disclaimer, the term of this patent is extended or adjusted under 35 U.S.C. 154(b) by 0 days.

(21) Appl. No.: 17/584,399

(22) Filed: Jan. 26, 2022

(65) Prior Publication Data

US 2022/0238291 A1 Jul. 28, 2022

(30) Foreign Application Priority Data

Jan. 27, 2021 (KR) ..... 10-2021-0011901

(51) Int. Cl.
*H01H 71/52* (2006.01)
*H01H 71/04* (2006.01)

(52) U.S. Cl.
CPC ..... *H01H 71/521* (2013.01); *H01H 71/04* (2013.01); *H01H 2071/046* (2013.01)

(58) Field of Classification Search
CPC ..... H01H 71/521; H01H 71/04; H01H 2071/046; H01H 2003/00; H01H 2003/02; H01H 2009/00; H01H 2009/02; H01H 2221/016; H01H 2223/00; H01H 2223/008; H01H 2223/044; H01H 2239/044; H01H 9/00; H01H 9/02; H01H 9/0005; H01H 9/0016; H01H 9/0044; H01H 9/0264; H01H 19/00; H01H 19/04; H01H 21/12; H01H 21/04; H01H 21/22; H01H 3/00; H01H 3/02; H01H 3/04; H01H 3/08; H01H 3/06; H01H 3/10; H01H 3/32; H01H 3/46; H01R 39/00
USPC ..... 200/237
See application file for complete search history.

(56) References Cited

U.S. PATENT DOCUMENTS 8,076,598 B2 * 12/2011 Billard ..... H01H 9/22 200/50.06

FOREIGN PATENT DOCUMENTS

| | | | |
|---|---|---|---|
| CN | 203910592 U | * | 10/2014 |
| JP | 1999234816 A | | 8/1999 |
| JP | 2014166122 A | | 9/2014 |
| KR | 1019980034677 A | | 8/1998 |
| KR | 1020050102300 A | | 10/2005 |

OTHER PUBLICATIONS

Korean Intellectual Property Office, Office Action for Korean Patent Application No. 10-2021-00011901, dated Sep. 1, 2022, 4 pages.

* cited by examiner

*Primary Examiner* — Anthony R Jimenez
(74) *Attorney, Agent, or Firm* — Nicholas Park

(57) ABSTRACT

Disclosed herein is an industrial cut-off switch for visual identification of power system cut-off status. The industrial cut-off switch includes an enclosure having an accommodation space therein, a handle disposed on an outer surface of the enclosure and having a gripping part extending in one direction, and a switch unit disposed inside the enclosure, and connected to the handle operated to adjust an on/off state of the switch unit.

4 Claims, 8 Drawing Sheets

INDUSTRIAL CUT-OFF SWITCH FOR VISUAL IDENTIFICATION OF POWER SYSTEM CUT-OFF STATUS

CROSS-REFERENCE TO RELATED APPLICATION

This application claims priority to and the benefit of Korean Patent Application No. 10-2021-0011901, filed on Jan. 27, 2021, the disclosure of which is incorporated herein by reference in its entirety.

BACKGROUND

The present invention relates to a switch.

In general, a circuit breaker serves to cut off supply of electric current. An operator uses a circuit breaker to cut off the electric current supplied to machines for safe inspection or repair thereof.

A conventional circuit breaker is turned on/off with a button switch to cut off the supply of external power. Due to the small size as well as the structural characteristics of the button switch, it is not clearly revealed that the button switch is pressed. Hence, it may be difficult for an operator to recognize the on/off state of the circuit breaker when the operator checks machines away from the circuit breaker.

In addition, the operator may be easily exposed to the risk of electric shock by touching bus bars or contact with electric wires in the process of operating the button switch exposed to the outside.

Accordingly, the inventor of the present invention has devised and completed the invention after long research and by trial and error in order to solve these issues.

SUMMARY OF THE INVENTION

Therefore, the present invention has been made in view of the above problems, and it is an object of the present invention to provide a switch capable of recognizing whether power is cut off with the naked eye easily from the outside.

It is another object of the present invention to provide a switch that can be safely operated without the risk of electric shock in the process of cutting off power.

In accordance with the present invention, the above and other objects can be accomplished by the provision of an industrial cut-off switch for visual identification of power system cut-off status, which includes an enclosure having an accommodation space therein, a handle disposed on an outer surface of the enclosure and having a gripping part extending in one direction, and a switch unit disposed inside the enclosure, and connected to the handle operated to adjust an on/off state of the switch unit, wherein the handle is connected to the enclosure so as to be rotatable about a point attached to the outer surface of the enclosure, and turns the switch unit on and off at a predetermined position of rotation so as to enable a user to recognize the on/off state of the switch unit.

The switch unit may include a first connector extending outward from one surface thereof to be electrically connected to an external power source, and a second connector extending outward from the other surface thereof to be electrically connected to a power supply unit. The switch unit may control whether energization between the external power source and the power supply unit is performed between the first connector and the second connector by operating the handle. The handle may include a shaft coupled to the switch unit through the enclosure and extending in one direction, and the shaft may transmit rotational energy of the handle to the switch unit to adjust the on/off state of the switch unit.

The enclosure may include a main body, which is open at one surface thereof, and having the accommodation space therein, and a door hinged to one side of the main body so as to be openable and closable on the open surface of the main body. The main body may include a step on the other side thereof, the step extending inward from one surface of the main body that abuts the closed door and being bent toward the door at least once.

The industrial cut-off switch may include a bus bar connected to each of the connectors of the switch unit, and an insulation plate disposed in front of the connector to prevent an electric shock accident from the bus bar and the connector, thereby preventing contact with the connector and the bus bar. The enclosure may include a roof, which extends horizontally from the top thereof, is bent at least once, and then extends obliquely downward.

The industrial cut-off switch may include an electric shock prevention unit connected to an external power source and configured to control supply of external power by opening and closing the door. The electric shock prevention unit may maintain the supply of external power while the door is closed, and the electric shock prevention unit may cut off the supply of external power while the door is open.

The industrial cut-off switch may include a protruding member disposed on an inner surface of the door, and a fixing member disposed on an inner surface of the main body to face the protruding member while the door is closed. The electric shock prevention unit may include a body fixedly fitted to the fixing member, a pair of energization bars disposed on one side of the body and extending in one direction, and a push bar disposed on the other side of the body and inserted thereinto by external pressure so as to supply external power. The electric shock prevention unit may pressurize the push bar of the fixing member in the process of closing the door to supply external power, and the electric shock prevention unit may release the pressure on the push bar in the process of opening the door to cut off external power.

The industrial cut-off switch may include a safety locking device to adjust opening and closing of the door with magnetism. The safety locking device may include a pair of receptacles disposed on respective outer peripheral surfaces of the door and the main body, a pinion embedded in the receptacle disposed on the outer peripheral surface of the main body, a pair of magnetic parts embedded in the respective receptacles, a magnetic blocking part disposed on one side of the pinion and embedded in the associated receptacle, and a rack embedded in the associated receptacle so as to engage with the pinion. The rack may include a stick, which is in the form of a protrusion and extends to be exposed through a cutout rail formed in the main-body-side receptacle. The magnetic blocking part may be disposed on the side of the pinion in the radial vicinity of the pinion. The magnetic part embedded in the main-body-side receptacle may be located within the radius of the pinion so as not to collide with the rotating magnetic blocking part. The magnetic blocking part may be disposed between the pair of magnetic parts while rotating by rotation of the pinion along with left and right movement of the rack, thereby blocking the magnetic force of the magnetic parts to open the door.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

In certain embodiments, a detailed description of functions well known in the art may be omitted to avoid obscuring appreciation of the invention by those skilled in the art. Hereinafter, the present invention will be described in detail with reference to the accompanying drawings.

Figure 1:
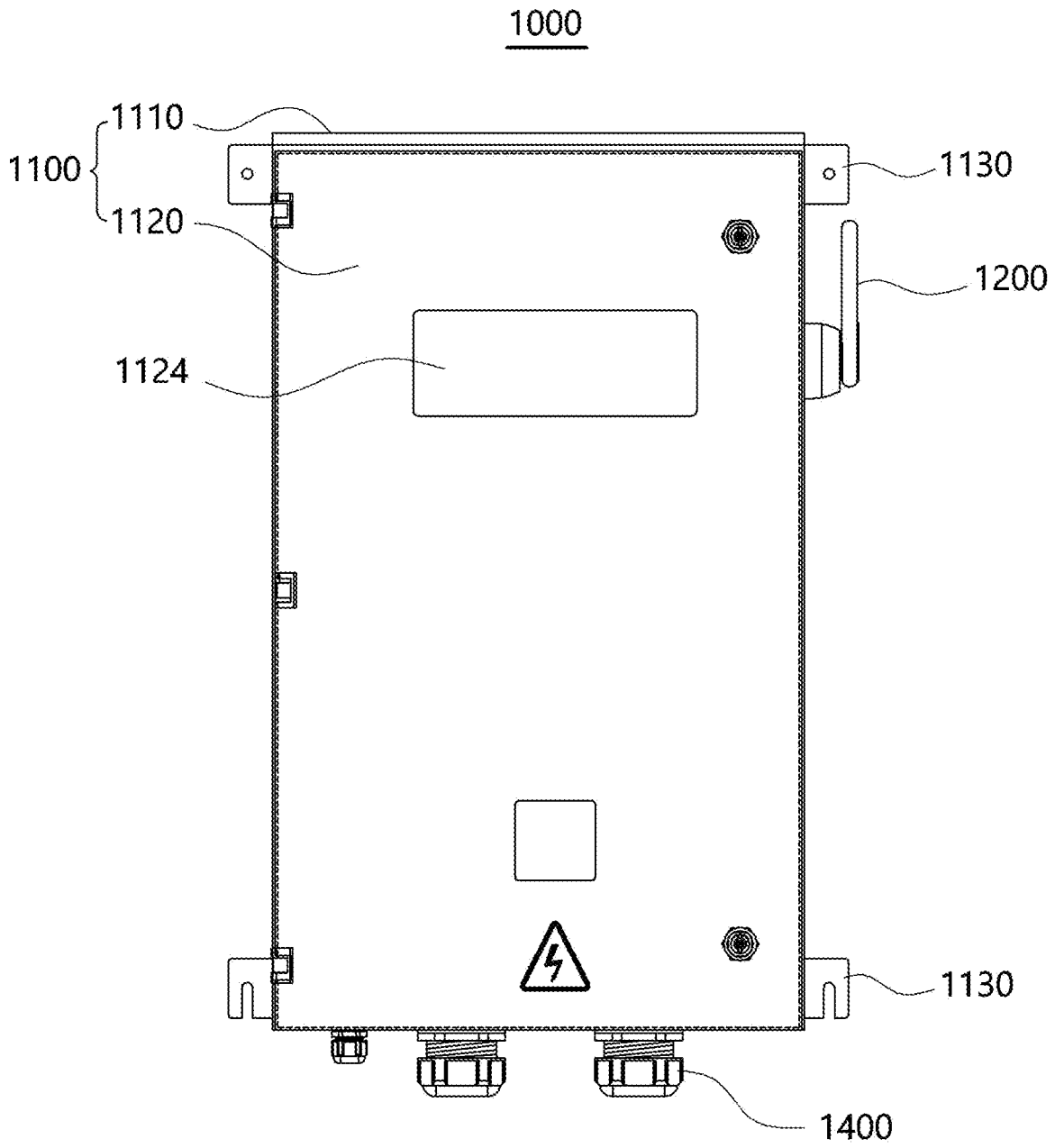
FIG. 1 is a front view illustrating a first embodiment according to the present invention.
Figure 2:
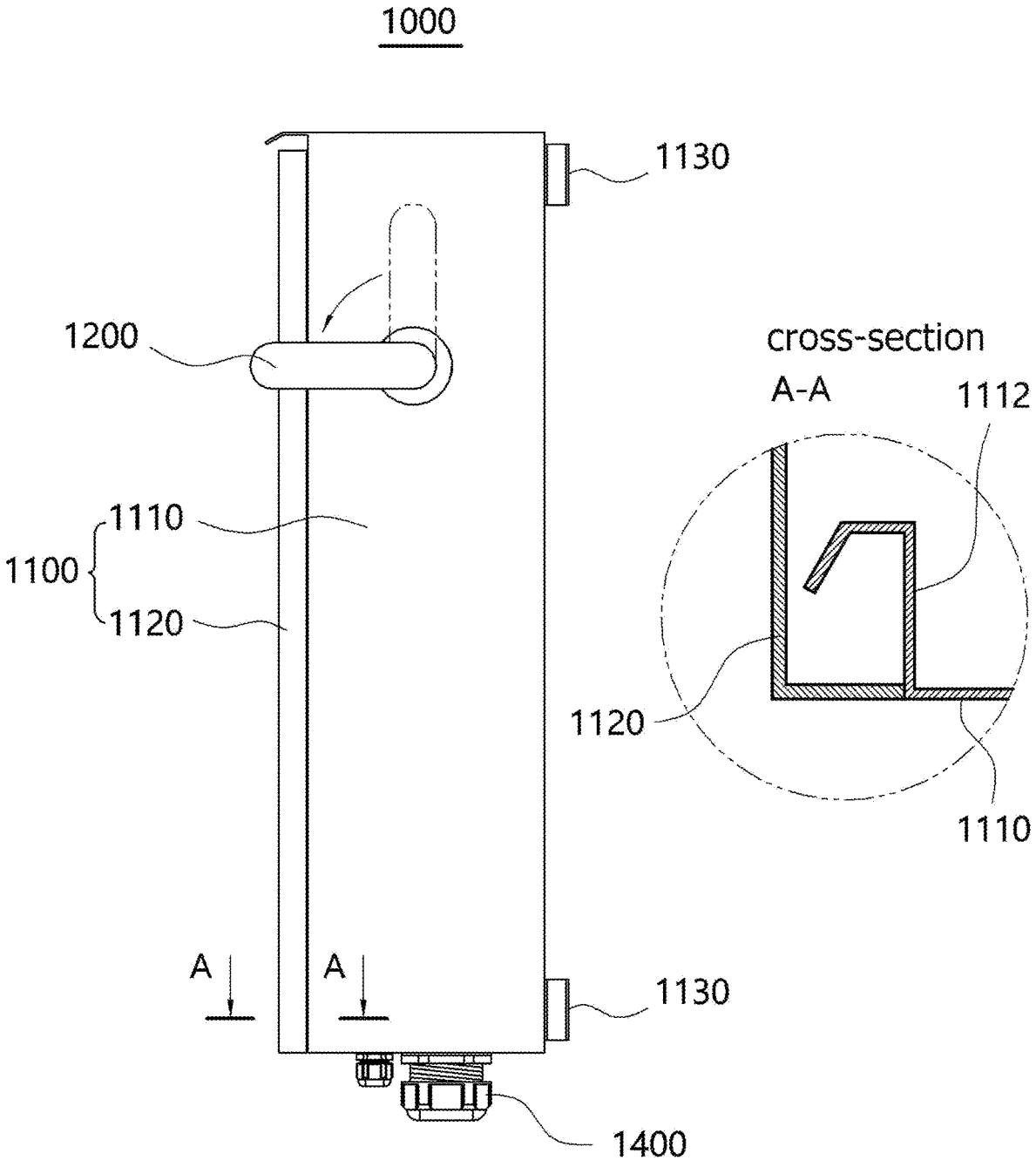
FIG. 2 is a side view illustrating the first embodiment according to the present invention.

FIG. 1 is a front view illustrating a first embodiment 1000 according to the present invention. FIG. 2 is a side view illustrating the first embodiment 1000 according to the present invention. As can be seen in FIGS. 1 and 2, the first embodiment 1000 according to the present invention includes an enclosure 1100, a handle 1200, and a switch unit 1300.

The enclosure 1100 includes an accommodation space capable of accommodating instruments, devices, or the like therein. The enclosure 1100 may have various shapes. In the first embodiment 1000, the enclosure 1100 is in the form of a rectangular parallelepiped and includes the switch unit 1300, bus bars 1510, or the like, which will be described later, in the accommodation space therein.

The handle 1200 serves to control the switch unit 1300, and is disposed on the outer surface of the enclosure 1100. The handle 1200 has a shape extending in one direction so that it can be easily gripped by a user's hand. The handle 1200 is connected to the enclosure 1100 so as to be rotatable about a point attached to the outer surface of the enclosure 1100. The handle 1200 turns the switch unit 1300 on and off at a predetermined position of rotation, thereby enabling a user to easily recognize whether the switch unit 1300 is turned on or off. In addition, the user may check the on/off state of the switch unit 1300 by checking the inside of the enclosure 1100 through a window 1124 of a door 1120, which will be described later, at a close distance.

The switch unit 1300 is disposed inside the enclosure 1100 and is connected to the handle 1200, which is disposed on the outer surface of the housing 1100 and is operated to adjust the on/off state of an external power supply by manipulating the handle 1200.

Figure 3:
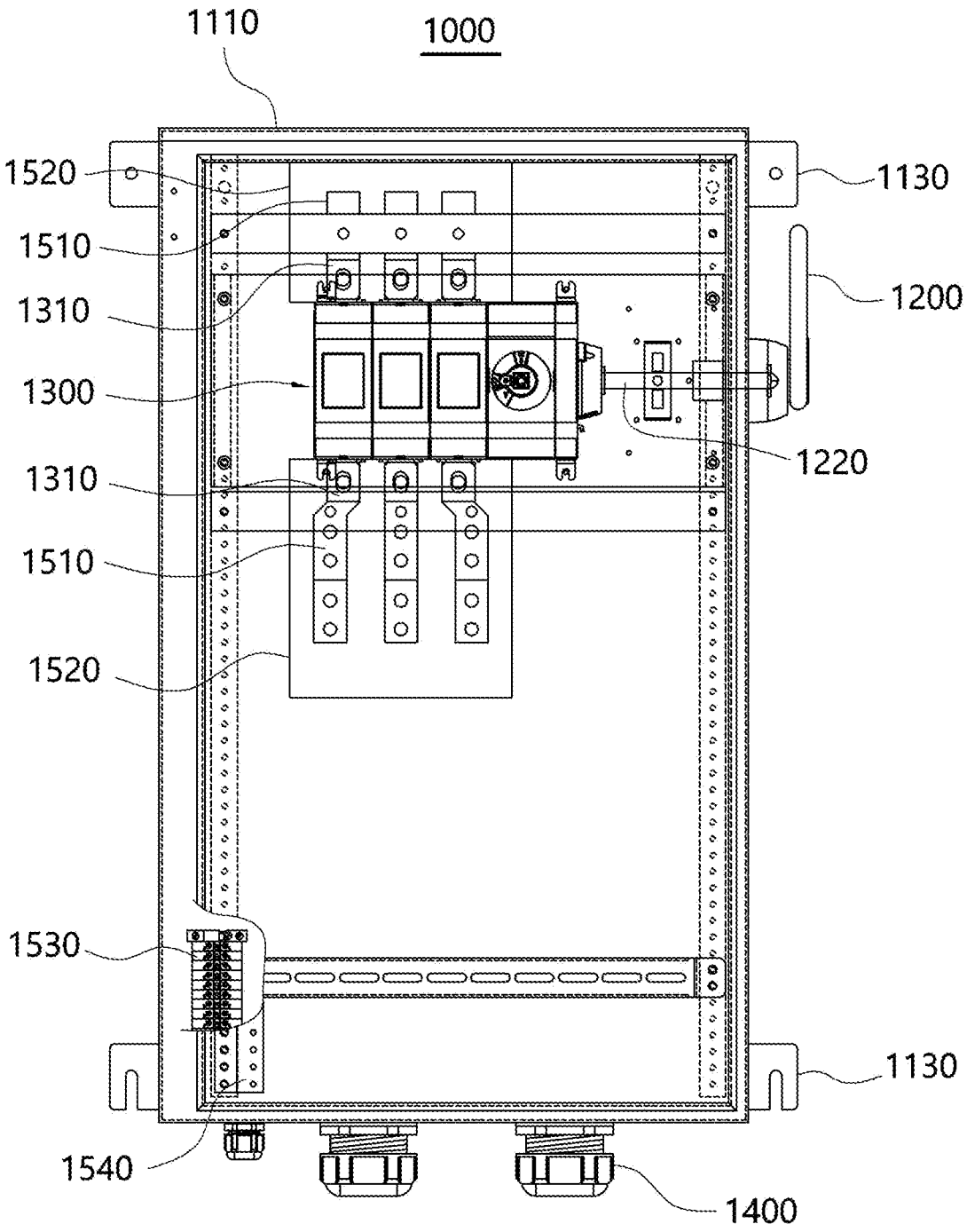
FIG. 3 is a front view illustrating an internal configuration in the first embodiment according to the present invention.

FIG. 3 is a front view illustrating an internal configuration in the first embodiment 1000 according to the present invention. As can be seen in FIG. 3, the switch unit 1300 includes a first connector 1310 and a second connector 1320, which are electrically connected to the bus bars 1510.

The first connector 1310 extends upward from the upper surface of the switch unit 1300, and the second connector 1320 extends downward from the lower surface of the switch unit 1300. The first connector 1310 is electrically connected to an external power source, and the second connector 1320 is electrically connected to a power supply unit. That is, the switch unit 1300 is positioned between a line electrically connected to the external power source and a line electrically connected to the power supply unit. The switch unit 1300 activates or deactivates energization between the external power source and the power supply unit by operating the handle 1200. Although the first and second connectors 1310 and 1320 are described as being connected to specific targets in the first embodiment 1000, the present invention is not necessarily limited thereto. The first connector 1310 may be electrically connected to the power supply unit, and the second connector 1320 may be electrically connected to the external power source.

The handle 1200 includes a shaft 1220, which is coupled to the switch unit 1300 through the enclosure 1100 and extends in one direction. The shaft 1220 transmits the rotational energy of the handle 1200 to the switch unit 1300 to adjust the on/off state of the switch unit 1300.

In the first embodiment 1000 according to the present invention, the enclosure 1100 may completely block the inflow of foreign substances through a unique sealing structure. The enclosure 1100 includes a main body 1110, which is open at one surface thereof and has the accommodation space therein. The main body 1110 may be fixed to a wall surface through a bracket 1130 coupled to one surface thereof. The enclosure 1100 includes the door 1120 hinged to one side of the main body 1110 so as to be openable and closable on the open surface of the main body 1110. The enclosure 1100 may seal the accommodation space thereof using the door 1120.

Compared with one side of the main body 1110 on which the door 1120 is disposed, the main body 1110 includes a step 1112 on the other side thereof. As can be seen in FIG. 2, the step 1112 extends inward from one surface of the main body 1110 that abuts the closed door 1120. The step 1112 is bent toward the door 1120 at least once. In the first embodiment 1000, the step 1112 is bent toward the door 1120, and is further bent obliquely at the end thereof to secondarily prevent the inflow of foreign substances.

The first embodiment 1000 includes the bus bars 1510 connected to the connectors 1310 and 1320 of the switch unit 1300. As can be seen in FIG. 3, the first embodiment 1000 includes an insulation plate 1520 disposed in front of the connectors 1310 and 1320 to prevent an electric shock accident from the bus bars 1510 and the connectors 1310 and 1320. The insulation plate 1520 prevents a user from coming into contact with the connectors 1310 and 1320 and the bus bars 1510 to prevent an electric shock accident. The insulation plate 1520 may be made of a material that is a poor conductor of electricity, and may be, for example, an acrylic plate. The first embodiment 1000 includes a terminal block 1530 that may constitute a circuit through connection with different wires, and an earth bar 1540 serving as a ground.

The enclosure 1100 includes a roof 1114 to prevent the inflow of materials falling from above. As can be seen in FIG. 2, the roof 1114 extends horizontally from the top of the enclosure 1100, is bent at least once, and then extends obliquely downward.

Figure 4:
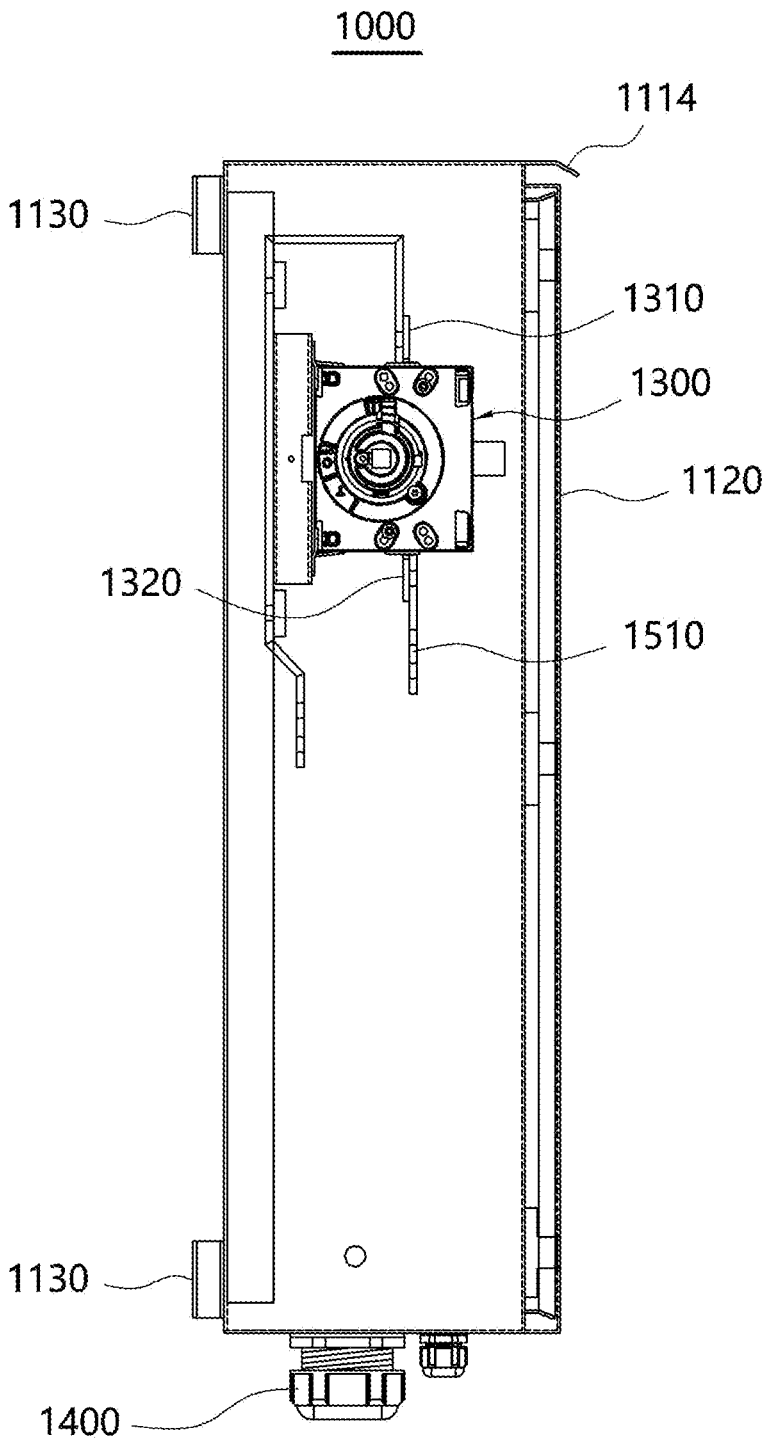
FIG. 4 is a side view illustrating the internal configuration in the first embodiment according to the present invention.

FIG. 4 is a side view illustrating the internal configuration in the first embodiment according to the present invention. As can be seen in FIG. 4, the bus bar 1510 connected to the first connector 1310 extends downward in a C-shape. The bus bar 1510 connected to the second connector 1320 extends downward. Since the bus bars 1510 have ends connected to cables and concentrated in the lower portion of the enclosure 1100, it is convenient to connect the bus bars 1510 to the cable coming into the enclosure 1100 from the outside, together with easy management thereof.

Figure 5A:
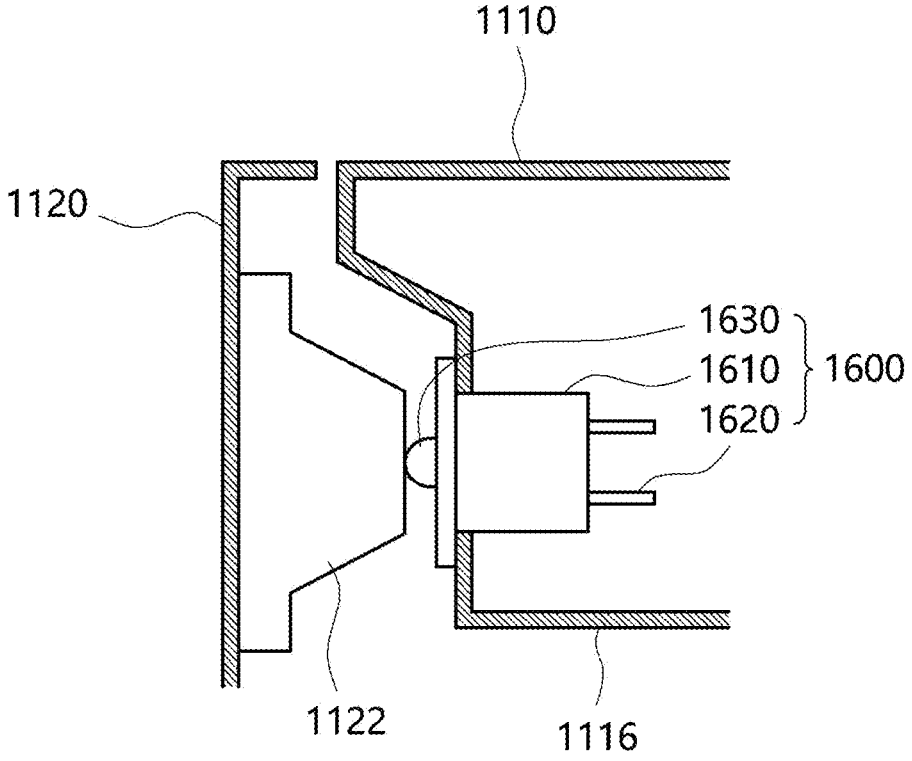
FIGS. 5A and 5B are views illustrating a modified example of section A of FIG. 2.
Figure 5B:
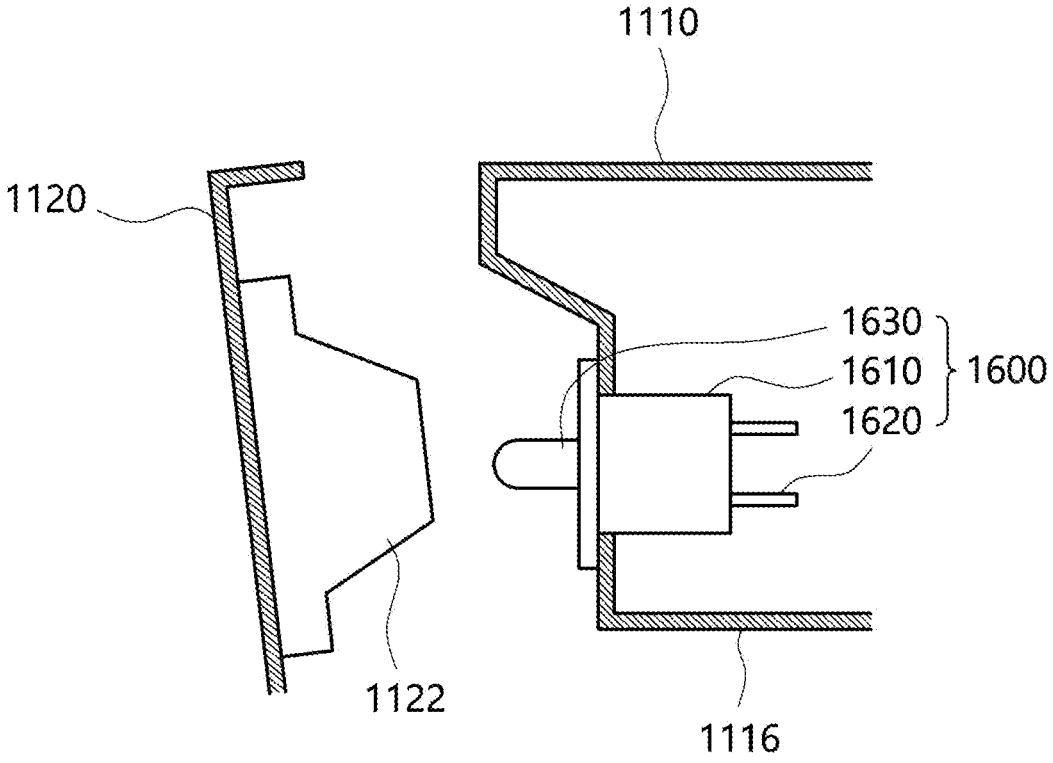

FIGS. 5A and 5B are views illustrating a modified example of section A of FIG. 2. In FIG. 5A, illustrates that the door 1120 is closed, and FIG. 5B illustrates that the door 1120 is opened. As can be seen in FIGS. 5A and 5B, the present invention may include an electric shock prevention unit 1600, which is connected to the external power source and controls the supply of external power by opening and closing the door 1120. The external power source is connected to the electric shock prevention unit 1600 before connection to the switch unit 1300. Since the electric shock prevention unit 1600 cuts off external power when the door 1120 is opened, the switch unit 1300 is deenergized while the door 1120 is open.

Specifically, the electric shock prevention unit 1600 includes a body 1610, an energization bar 1620, and a push bar 1630. The body 1610 is fixedly fitted to a fixing member 1116 disposed on the inner surface of the main body 1110. The fixing member 1116 is disposed to face a protruding member 1122 disposed on the inner surface of the door 1120 while the door 1120 is closed. The energization bar 1620 is disposed on one side of the body 1610 and extends in one direction. The energization bar 1620 consists of a pair of energization bars, each electrically connected to the external power source. The push bar 1630 is disposed on the other side of the body 1610 and is inserted into the body 1610 by external pressure, so as to supply external power. That is, the electric shock prevention unit 1600 pressurizes the push bar 1630 of the fixing member 1116 in the process of closing the door 1120 to supply external power as illustrated in FIG. 5A, whereas it releases the pressure on the push bar 1630 in the process of opening the door 1120 to cut off external power. Accordingly, the user can open the door 1120 to safely inspect the inside of the enclosure 1100.

[Safety Locking Device]

Figure 6A:
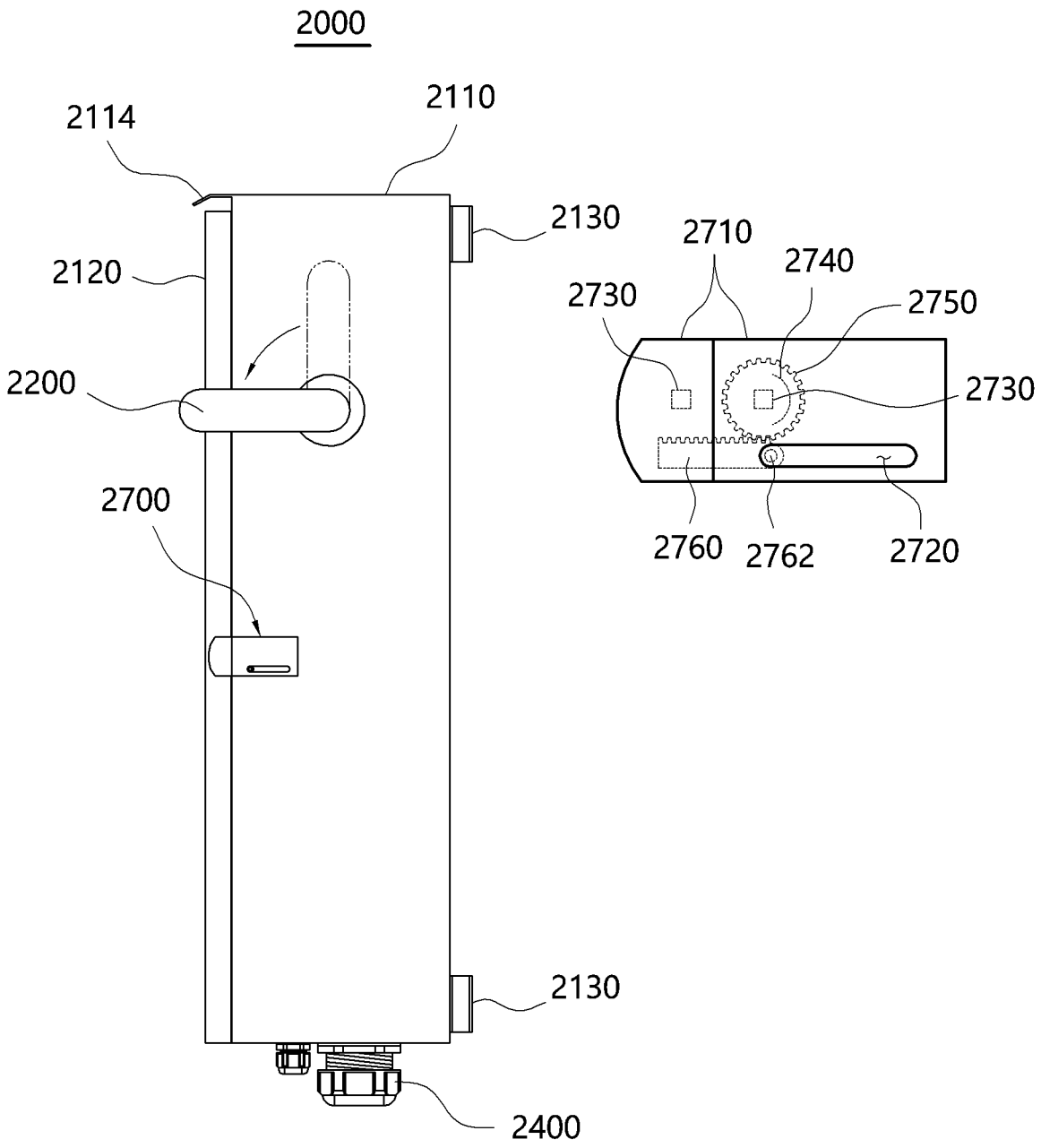
FIG. 6 is a view illustrating a second embodiment according to the present invention.
Figure 6B:
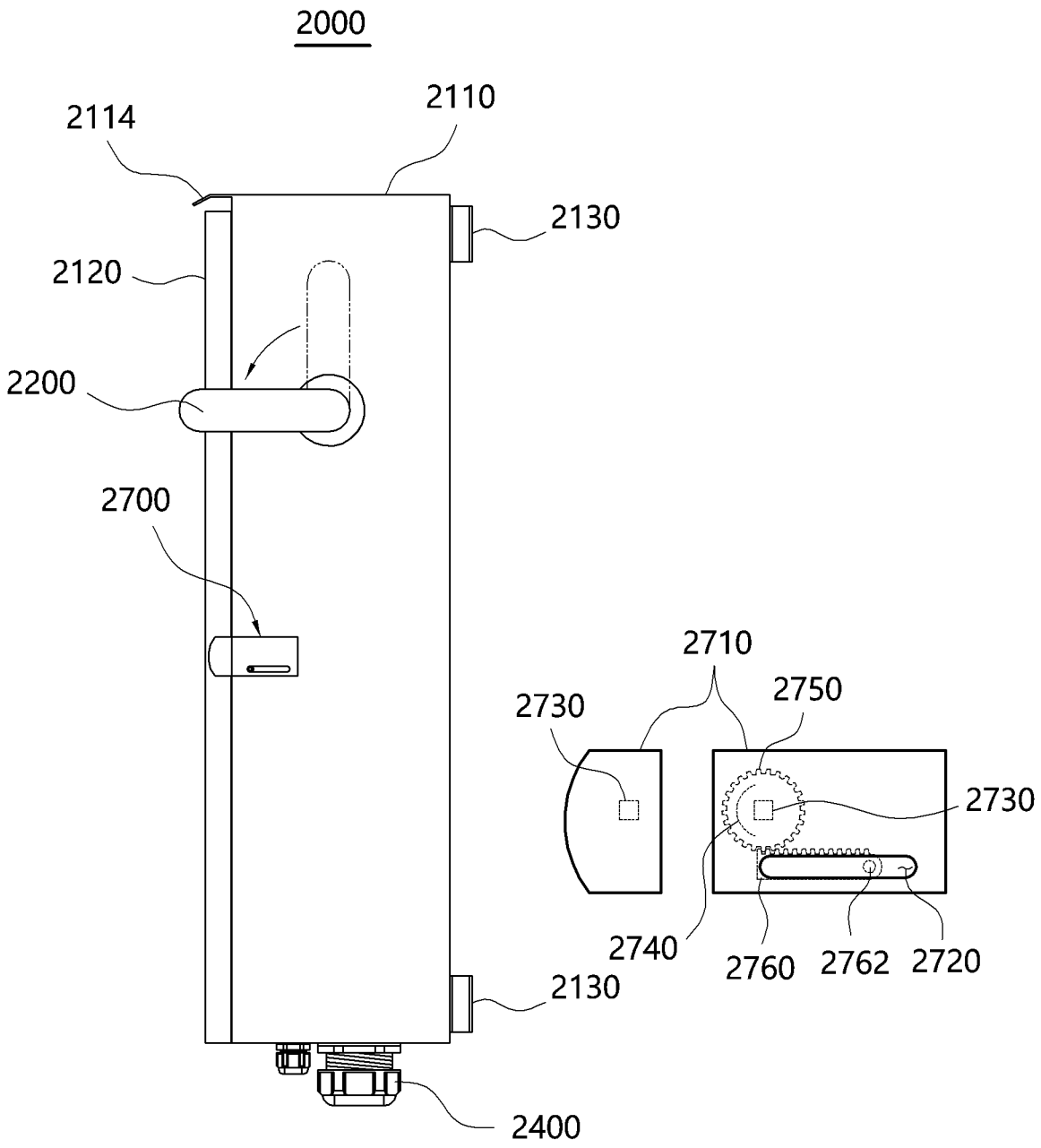

FIG. 6 is a view illustrating a second embodiment 2000 according to the present invention. As can be seen in FIG. 6, the second embodiment 2000 includes a safety locking device 2700 to adjust the opening and closing of the door with magnetism. The safety locking device 2700 is a device that safely and conveniently opens and closes the door. The safety locking device 2700 includes a pair of receptacles 2710, a pinion 2750, a pair of magnetic parts 2730, a magnetic blocking part 2740, and a rack 2760.

The pair of receptacles 2710 is disposed on the outer peripheral surfaces of each of the door and the main body, respectively. The toothed pinion 2750 is embedded in the main-body-side receptacle 2710 disposed on the main body. The rack 2760 having teeth on one surface thereof is disposed beneath the pinion 2750. As the rack 2760 moves from side to side, the pinion 2750 is able to rotate. The rack 2760 includes a stick 2762 for left and right movement by user's operation. The stick 2762 is in the form of a protrusion and extends to be exposed through a cutout rail 2720 formed in the main-body-side receptacle 2710.

The pair of magnetic parts 2730 is provided in the pair of receptacles 2710, respectively, The magnetic parts 2730 generate a magnetic force, and each may be, for example, a magnet. The pair of magnetic parts 2730 is attached to each other by magnetic attraction, so that the pair of receptacles 2710 is attached to each other. Accordingly, the door remains closed, as illustrated in FIG. 6.

The user may block the magnetic force between the pair of magnetic parts 2730 by rotating the magnetic blocking part 2740 in order to open the door. The magnetic blocking part 2740 is disposed on one side of the pinion 2750 in the state in which it is embedded in the associated receptacle 2710. The magnetic blocking part 2740 is disposed on the side of the pinion 2750 in the radial vicinity of the pinion 2750. In response, the magnetic part 2730 embedded in the main-body-side receptacle 2710 is located within the radius of the pinion 2750 so as not to collide with the rotating magnetic blocking part 2740. Accordingly, the magnetic blocking part 2740 is disposed between the pair of magnetic parts 2730 while rotating by rotation of the pinion 2750 along with the left and right movement of the rack 2760, thereby blocking the magnetic force of the magnetic parts 2730 to open the door.

As is apparent from the above description, the present invention provides the switch capable of easily checking whether external power is cut off with the naked eye even from a distance.

In addition, the present invention provides the switch that enables safe operation without an electric shock accident in the process of cutting off power.

It is apparent to those skilled in the art that the present invention may be embodied in different forms without departing from the spirit and scope of the invention. Accordingly, the present invention should be construed not as restrictive but merely as illustrative in all respects. It is contemplated that any and all such embodiments are included in the present invention as may fall within the literal or equivalent scope of the invention as defined in the following claims.

What is claimed is:

1. An industrial cut-off switch for visual identification of a power system cut-off status, comprising:

an enclosure having an accommodation space therein and comprising a roof which extends horizontally from a top thereof, is bent at least once, and extends obliquely downward, and a main body which is open at one surface thereof, and having the accommodation space therein, comprising a step on one side thereof, the step extending outward from one surface of the main body that abuts a closed door and being bent toward the door at least once;

a handle disposed on an outer surface of the enclosure and having a gripping part extending in one direction;

a switch unit disposed inside the enclosure, and connected to the handle operated to adjust an on/off state of the switch unit, comprising a first connector extending outward from one surface of the switch unit to be electrically connected to an external power source, and a second connector extending outward from an other surface of the switch unit to be electrically connected to a power supply, and controlling whether energization between the external power source and the power supply is performed between the first connector and the second connector by operating the handle;

a bus bar connected to each of the first connector and the second connector of the switch unit; and an insulation plate disposed in front of the first connector and the second connector to prevent an electric shock from the bus bar, the first connector and the second connector, thereby preventing contact with the bus bar, the first connector, and the second connector, wherein the handle comprises a shaft transmitting rotational energy of the handle to the switch unit to adjust the on/off state of the switch unit, coupled to the switch unit through the enclosure and extending in one direction, and is connected to the enclosure so as to be rotatable about a point attached to the outer surface of the enclosure, and turns the switch unit on and off at a predetermined position of rotation so as to enable a user to recognize the on/off state of the switch unit.

2. The industrial cut-off switch according to claim 1, wherein the enclosure comprises:

a door hinged to one side of the main body so as to be openable and closable on the open surface of the main body.

3. The industrial cut-off switch according to claim 2, comprising:

an electric shock prevention unit connected to an external power source and configured to control supply of external power by opening and closing the door, wherein the electric shock prevention unit maintains the supply of external power while the door is closed, the electric shock prevention unit cuts off the supply of external power while the door is open, and wherein the electric shock prevention unit comprises a body fixedly fitted to a fixing member; a pair of energization bars disposed on one side of the body and extending in one direction, each energized with the external power source; and a push bar disposed on an other side of the body and inserted thereinto by external pressure so as to supply external power.

4. The industrial cut-off switch according to claim 3, comprising:

a protruding member disposed on an inner surface of the door; and the fixing member disposed on an inner surface of the main body to face the protruding member while the door is closed, wherein the electric shock prevention unit pressurizes the push bar of the fixing member in the process of closing the door to supply external power, and the electric shock prevention unit releases the pressure on the push bar in the process of opening the door to cut off external power.

* * * * *